US009628931B2

(12) United States Patent
Enamito et al.

(10) Patent No.: US 9,628,931 B2
(45) Date of Patent: Apr. 18, 2017

(54) APPARATUS AND METHOD FOR LOCATING AN ACOUSTIC SIGNAL ALONG A DIRECTION NOT OVERLAPPED WITH AN ARRIVING DIRECTION OF AN INFORMATION SOUND

(71) Applicant: Kabushiki Kaisha Toshiba, Minato-ku, Tokyo (JP)

(72) Inventors: Akihiko Enamito, Kanagawa (JP); Keiichiro Someda, Kanagawa (JP); Takahiro Hiruma, Tokyo (JP); Osamu Nishimura, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/658,510

(22) Filed: Mar. 16, 2015

(65) Prior Publication Data

US 2015/0281867 A1 Oct. 1, 2015

(30) Foreign Application Priority Data

Mar. 31, 2014 (JP) ..... 2014-074492

(51) Int. Cl.
*H04S 1/00* (2006.01)
*H04S 7/00* (2006.01)

(52) U.S. Cl.
CPC ..... *H04S 1/005* (2013.01); *H04S 7/302* (2013.01); *H04S 7/304* (2013.01); *H04S 2400/11* (2013.01); *H04S 2420/01* (2013.01)

(58) Field of Classification Search
None
See application file for complete search history.

(56) References Cited

U.S. PATENT DOCUMENTS

2005/0117761 A1 6/2005 Sato
2006/0133619 A1* 6/2006 Curry ..... H04M 3/56 381/26

(Continued)

FOREIGN PATENT DOCUMENTS

JP 10-145852 5/1998
JP 2001-318594 11/2001

(Continued)

OTHER PUBLICATIONS

Extended European Search Report issued by the European Patent Office on Aug. 7, 2015, for European Patent Application No. 15156925.8.

*Primary Examiner* — Wayne Young
*Assistant Examiner* — Mark Fischer
(74) *Attorney, Agent, or Firm* — Finnegan, Henderson, Farabrow, Garrett & Dunner LLP

(57) ABSTRACT

According to one embodiment, an acoustic control apparatus includes an acquisition unit, a detection unit, a correction unit, and an output unit. The acquisition unit acquires a first acoustic signal. The detection unit detects an information sound. When the detection unit detects the information sound, the correction unit corrects the first acoustic signal to a second acoustic signal by convoluting the first acoustic signal with a first function. The first function represents an acoustic transfer characteristic from a virtual position to a listening position. The virtual position is located along a first direction from the listening position. The output unit outputs the second acoustic signal.

5 Claims, 4 Drawing Sheets

(56) References Cited

U.S. PATENT DOCUMENTS

| | | | | |
|---|---|---|---|---|
| 2010/0150367 | A1* | 6/2010 | Mizuno | G10K 11/1782 381/71.6 |
| 2014/0300636 | A1 | 10/2014 | Miyazaya et al. | |
| 2015/0010160 | A1* | 1/2015 | Udesen | H04R 25/70 381/60 |
| 2015/0098571 | A1 | 4/2015 | Jarvinen et al. | |

FOREIGN PATENT DOCUMENTS

| | | |
|---|---|---|
| JP | 2003-264899 | 9/2003 |
| JP | 2004-201194 | 7/2004 |
| JP | 2004-201195 | 7/2004 |
| JP | 2005-37181 | 2/2005 |
| JP | 2008-193382 | 8/2008 |
| JP | 2009-188450 | 8/2009 |
| WO | WO 2013/114831 A1 | 8/2013 |
| WO | WO 2013/156818 A1 | 10/2013 |

* cited by examiner

APPARATUS AND METHOD FOR LOCATING AN ACOUSTIC SIGNAL ALONG A DIRECTION NOT OVERLAPPED WITH AN ARRIVING DIRECTION OF AN INFORMATION SOUND

CROSS-REFERENCE TO RELATED APPLICATION

This application is based upon and claims the benefit of priority from Japanese Patent Application No. 2014-074492, filed on Mar. 31, 2014; the entire contents of which are incorporated herein by reference.

FIELD

Embodiments described herein relate generally to an acoustic control apparatus, an electronic device, and an acoustic control method.

BACKGROUND

Many persons often listen to music by attaching a tool such as an earphone or a headphone thereto (Hereinafter, the tool is called "earphone"). When they listen to music by attaching the earphone, a sound such as a noise from the outside can be cut. However, a necessary sound (Hereinafter, it is called "information sound") as information from the outside is out in the same way. Here, for example, the information sound is a call from another person surrounding the listener, a guide voice for guidance, or a warning sound (such as a Klaxon from an automobile). Accordingly, when the listener listens to music with an earphone, even if the outside sound is cut by the earphone, it is desired for the listener not to miss the information sound because of prevention of danger and support of hearing sense.

On the other hand, by amplifying an information sound acquired by a microphone built in the earphone, an acoustic control device to present the information sound to the listener exists. However, a background noise having extremely high level is mixed in sounds from the city. Accordingly, by convoluting the amplified background noise therewith, it is hard for the listener to listen to the music (listening sound) as a listening target.

DETAILED DESCRIPTION

According to one embodiment, an acoustic control apparatus includes an acquisition unit, a detection unit, a correction unit, and an output unit. The acquisition unit acquires a first acoustic signal. The detection unit detects an information sound. When the detection unit detects the information sound, the correction unit corrects the first acoustic signal to a second acoustic signal by convoluting the first acoustic signal with a first function. The first function represents an acoustic transfer characteristic from a virtual position to a listening position. The virtual position is located along a first direction from the listening position. The output unit outputs the second acoustic signal.

Various embodiments will be described hereinafter with reference to the accompanying drawings.

(The First Embodiment)

Figure 1:
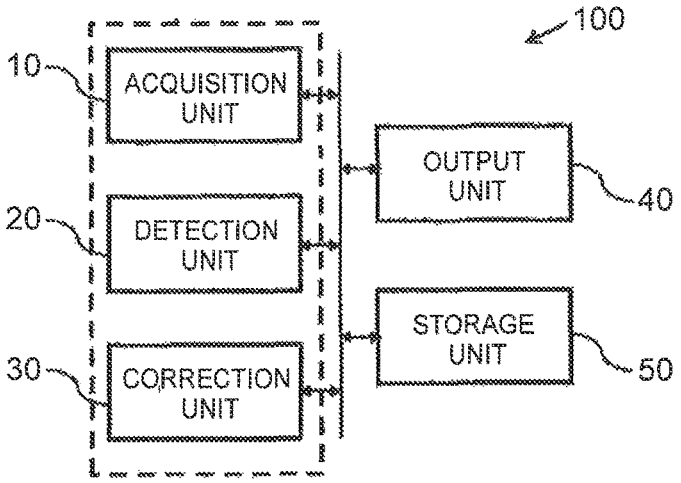
FIG. 1 is a block diagram of an acoustic control apparatus according to a first embodiment.

FIG. 1 is a block diagram of an acoustic control apparatus 100 according to the first embodiment. For example, the acoustic control apparatus 100 is used to an electronic device (such as a PC, a cellular-phone, a tablet terminal, a music-player, a TV, a radio) able to listen to a music or a sound (Hereinafter, it is called "listening sound") by using an earphone. The earphone can be connected to this acoustic control apparatus 100 wirelessly or with wired via an earphone jack (not shown in FIG. 1).

The acoustic control apparatus 100 of FIG. 1 includes an acquisition unit 10 to acquire an acoustic signal (first acoustic signal) of the listening sound, a detection unit 20 to detect the information sound, and a correction unit 30 to correct the acoustic signal so as to localize a sound image of the listening sound along a fixed direction when the detection unit 20 detects the information sound. Furthermore, the acoustic control apparatus 100 includes an output unit 40 to output the acoustic signal corrected by the correction unit 30 to the earphone. Here, the correction unit 30 corrects the acoustic signal by using a plurality of acoustic transfer characteristics previously stored in the storage unit 50.

The storage unit 50 is a recording medium such as a memory or a HDD. Furthermore, each processing of the acquisition unit 10, the detection unit 20 and the correction unit 30 is executed by an operation processor (such as a CPU) based on a program stored in the recording medium (For example, the storage unit 50).

The acquisition unit 10 acquires an acoustic signal (For example, a monaural signal). As a method for the acquisition unit 10 to acquire the acoustic signal, various methods can be applied. For example, by a terrestrial broadcasting or a satellite broadcasting such as a TV, an audio device or an AV device, a content including an acoustic signal (such as a content including the acoustic signal only, a content including the acoustic signal with a moving image or a static image, or a content including another related information therewith) can be acquired. The content may be acquired via an Internet, an Intranet, or a network such as a home-net. Furthermore, the content may be acquired by reading from a recording medium such as a CD, a DVD, or a disk device built-in. Furthermore, an input sound may be acquired by a microphone.

The detection unit 20 detects an information sound from the outside. The information sound is a sound needed to be listened preliminary or suddenly, for example, a localization sound listened from a fixed direction. As the information sound, a call from another person surrounding the listener, a public announcement, a guide voice for guidance, or a Klaxon from an automobile, are considered. Furthermore, as the information sound, such as an effective sound included in the listening sound as a stereophonic acoustic, a guide voice replayed as the stereophonic acoustic by the acoustic control apparatus 100 can be included. As a method for the detection unit 20 to detect the information sound, by equipping a microphone (not shown in FIG. 1), the acoustic control apparatus 100 can detect the information sound based on a sound detected by the microphone. In this case, by removing a component of the background noise from the sound detected by the microphone, a component larger than a fixed sound pressure level among the remained components can be detected as the information sound.

By executing filtering processing to the acoustic signal (a monaural signal) acquired by the acquisition unit 10, the correction unit 30 generates a stereophonic signal (an acoustic signal for a left earphone and an acoustic signal for a right earphone), and supplies each acoustic signal to the output unit 40. Here, if the acoustic signal acquired by the acquisition unit 10 is the stereophonic signal, the acquired acoustic signal is supplied to the output signal 40.

In the first embodiment, after the detection unit 20 detects the information sound, the correction unit 30 corrects the acoustic signal so as to a sound image of the listening sound along a fixed direction (localization direction) by using an acoustic transfer characteristic stored in the storage unit 50. Here, localization of the sound image along the fixed direction means, by filtering processing of the acoustic signal suitably, providing an effect to have the listener (listening position) be under an illusion so as to hear a sound (virtual sound) from a virtual position (virtual sound source) along the fixed direction.

Furthermore, as the localization direction, a direction not overlapped with arriving direction of the information sound, i.e., an arbitrary direction excluding a direction of the information sound, is desired. Here, for example, the localisation direction may be changed successively according to change of the arriving direction of the information sound. As the localization of the image sound, conventional technique of the stereophonic acoustic can be used. Here, the acoustic transfer characteristic is a function representing a transfer characteristic when a sound transfers from a virtual position (located at a fixed direction for a listener) to the listener, for example, a head-transfer function.

Figure 3:
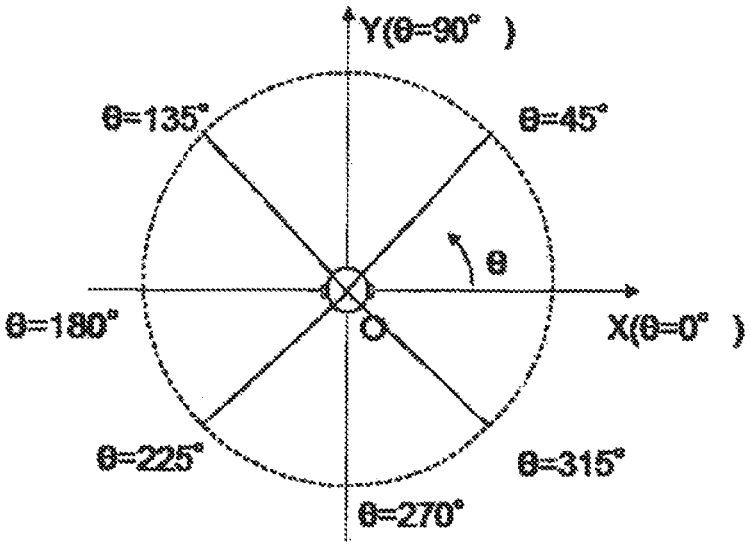
FIG. 3 is a schematic diagram to explain an acoustic transfer characteristic according to the first embodiment.

FIG. 3 is a schematic diagram to explain the acoustic transfer characteristic stored in the storage unit 50. As shown in FIG. 3, XY coordinate axis centering the listener as the origin 0 is thought about. Here, a positive direction along X-axis is the listener's right direction ($\theta=0°$), and a positive direction along Y-axis is the listener's front direction ($\theta=90°$). In an example of FIG. 3, the storage unit 50 stores acoustic transfer characteristics (For example, a set of acoustic transfer characteristics to a left ear and a right ear) corresponding to every 45° ($\theta=0°$, 45°, 90°, 135°, 180°, 225°, 270°, 315°). Each acoustic transfer characteristic represents a transfer characteristic when a sound transfers from the corresponding direction to the listener. By presenting an acoustic signal (acquired by convoluting the acoustic transfer characteristic therewith) to the listener, the sound image can be localized along the corresponding direction.

The correction unit 30 selects one from a plurality of acoustic transfer characteristics stored in the storage unit 50, and generates an acoustic signal $P_L$ for a left earphone and an acoustic signal $P_R$ for a right earphone by convoluting the selected one (a first acoustic transfer characteristic) with the acoustic signal. The correction unit 30 supplies each (generated) acoustic signal (a second acoustic signal) to the output unit 40.

For example, in order to localize the sound image at $\theta=90°$, the acoustic signal $P_L$ for the left earphone and the acoustic signal $P_R$ for the right earphone are generated by following equations. Here, $H_{L,90}$ represents the acoustic transfer characteristic to the left ear, $H_{R,90}$ represents the acoustic transfer characteristic to the right ear, and S represents the acoustic signal.

$$P_L=H_{L,90}\times S \tag{1}$$

$$P_R=H_{R,90}\times S \tag{2}$$

In the same way, in case of $\theta=135°$, the correction unit 30 selects acoustic transfer characteristics $H_{L,135}$ and $H_{R,135}$ for 135°. Namely, by using the acoustic transfer characteristic corresponding to the respective angle, the sound image can be localized along the desired direction.

The output unit 40 outputs each acoustic signal (acquired by the correction unit 30) to the earphone connected to the acoustic control apparatus 100 wirelessly or with wired via an earphone jack (not shown in FIG. 1). As a result, at a normal time when the information sound is not detected, the listener having the earphone listens to music and so on. On the other hand, at a time when the information sound is detected, the listener can listen to the listening sound as the localization sound along the fixed direction while listening to the information sound simultaneously.

Figure 2:
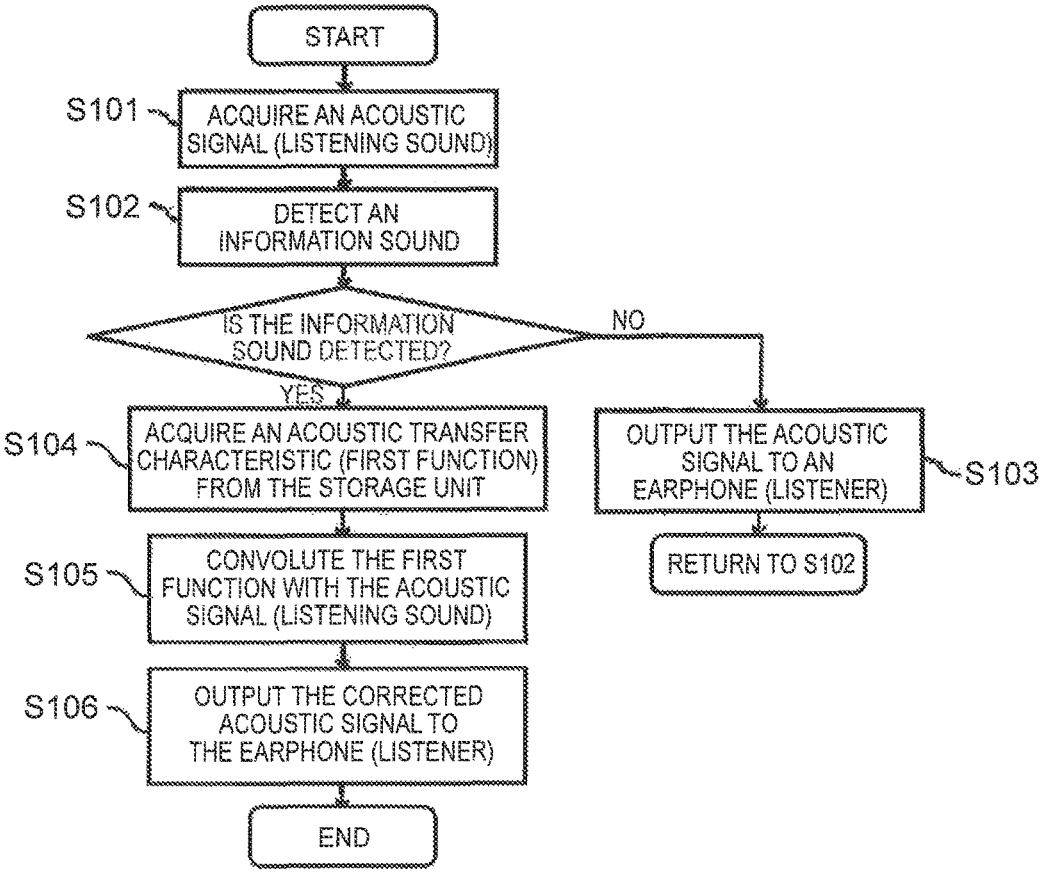
FIG. 2 is a flow chart of processing of an acoustic control method according to the first embodiment.

FIG. 2 is a flow chart of processing of the acoustic control method according to the first embodiment. At S101, the acquisition unit 10 acquires the acoustic signal (a first acoustic signal) of the listening sound.

As S102, the detection unit 20 detects the information sound. If the information sound is not detected, processing is forwarded to S103.

At S103, the output unit 40 outputs the first acoustic signal to the earphone (listener).

At S102, if the detection unit 20 detects the information sound, processing is forwarded to S104.

At S104, the correction unit 30 acquires the acoustic transfer characteristic (a first function) from the storage unit 50.

At S105, by convoluting the first function with the first acoustic signal, the correction unit 30 corrects the first acoustic signal to a second acoustic signal.

At S106, the output unit 40 outputs the second acoustic signal to the earphone (listener).

For example, above-mentioned steps are repeated until acquisition of the first acoustic signal is completed, or while the detection unit 20 is detecting the information sound.

Next, the localization direction of the sound image by the correction unit 30 will be explained. A plane defined by XY coordinate axis (shown in FIG. 3) is divided into four quadrants. Namely, they are a first quadrant ($0°\leq\theta<90°$), a second quadrant ($90°\leq\theta<180°$), a third quadrant ($180°\leq\theta<270°$), and a fourth quadrant ($270°\leq\theta<360°$).

In KY coordinate axis shown in FIG. 3, from respective combinations (correlative positional relationship) that the listening sound (P) and the information sound (S) are circularly placed at an interval of 45°, the correlative positional relationship easy to listen to the information sound is subjectively evaluated.

FIGS. 4A~4D shows results of the subjective evaluation. Here, the listening sound (P) existed in each quadrant is fixed, and a range easy to listen to the information sound (S) is shown. In FIGS. 4A~4D, the listener is set to the center, an angle of the listening sound (P) is $\theta_P$, and an angle (localisation angle) of the information sound (S) is $\theta_S$.

Figure 4A:
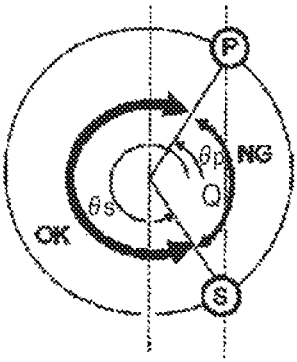
FIGS. 4A~4D are schematic diagrams showing subjective evaluation results according to the first embodiment.

As shown in FIG. 4A, if the listening sound (P) is fixed in the first quadrant ($\theta_P=45°$), the information sound (S) is easy to be listened in the angle range ($45°<\theta_S<315°$). Especially, in the angle range ($90°\leq\theta_S\leq270°$), the information sound (S) is further easy to be listened. On the other hand, in the angle range ($0° \leq \theta_S \leq 45°$) and ($315° \leq \theta_S \leq 360°$), the information sound (S) is hard to be listened.

Figure 4B:
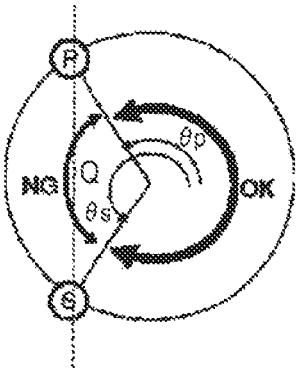

As shown in FIG. 4B, if the listening sound (P) is fixed in the second quadrant ($\theta_P = 135°$), the information sound (S) is easy to be listened in the angle range ($0° \leq \theta_S \leq 135°$) and ($225° < \theta_S \leq 360°$). Especially, in the angle range ($0° \leq \theta_S \leq 90°$) and ($270° \leq \theta_S \leq 360°$), the information sound (S) is further easy to be listened. On the other hand, in the angle range ($135° \leq \theta_S \leq 225°$), the information sound (S) is hard to be listened.

Figure 4C:
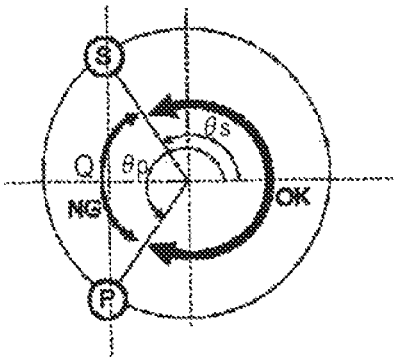

As shown in FIG. 4C, if the listening sound (P) is fixed in the third quadrant ($\theta_P = 225°$), the information sound (S) is easy to be listened in the angle range ($0° \leq \theta_S \leq 135°$) and ($225° < \theta_S \leq 360°$). Especially, in the angle range ($0° \leq \theta_S \leq 90°$) and ($270° \leq \theta_S \leq 360°$), the information sound (S) is further easy to be listened. On the other hand, in the angle range ($135° \leq \theta_S \leq 225°$), the information sound (S) is hard to be listened.

Figure 4D:
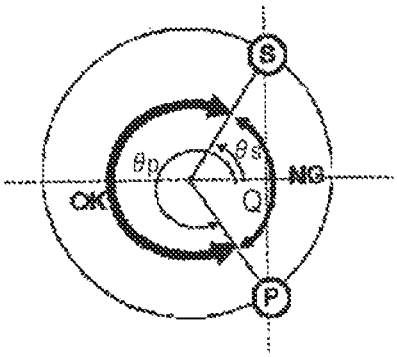

As shown in FIG. 4D, if the listening sound (P) is fixed in the fourth quadrant ($\theta_P = 315°$), the information sound (S) is easy to be listened in the angle range ($45 < \theta_S < 315°$). Especially, in the angle range ($90 \leq \theta_S \leq 270°$), the information sound (S) is further easy to be listened. On the other hand, in the angle range ($0° \leq \theta_S \leq 45°$) and ($315° \leq \theta_S \leq 360°$), the information sound (S) is hard to be listened.

From the above-mentioned, in the correlative positional relationship between the listening sound (P) and the information sound (S), on the basis of a cross point (Q) of a perpendicular line from a position of the listening sound (P) onto X-axis, if a cross point of a perpendicular line from a position of the information sound (S) onto X-axis is included in the listener's side area than the cross point (Q), the information sound (S) is easy to be listened. On the other hand, if the cross point of the perpendicular line from the position of the information sound (S) onto X-axis is included in the listener's opposite side area than the cross point (Q), the information sound (S) is hard to be listened. Moreover, even if the positional relationship between the listening sound (P) and the information sound (S) is reversed, the same result is acquired.

Accordingly, preferably, on the basis of a cross point (Q') of a perpendicular line from a position of the information sound (S) onto X-axis, under the condition that a cross point of a perpendicular line from a position of the listening sound (P) onto X-axis is included in the listener's side area than the cross point (Q'), any of directions of the listening sound (P) is set to a localization direction. More preferably, if a position of the information sound (S) exists in the first quadrant or the fourth quadrant (the right direction from the listener), any of directions (the left direction from the listener) under the condition ($90° \leq \theta_S \leq 270°$) is set to the localization direction. Furthermore, if a position of the information sound (B) exists in the second quadrant or the third quadrant (the left direction from the listener), any of directions (the right direction from the listener) under the condition ($0° \leq \theta_S \leq 90°$) or ($270° \leq \theta_S \leq 360°$) is set to the localization direction. The correction unit 30 had better select the acoustic transfer characteristic corresponding to this localization direction.

According to the acoustic control apparatus 100 of the first embodiment, at a timing when the information sound is inputted, by shifting the sound image of the listening sound along a direction not overlapped with the information sound, even if the listener listens to the listening sound with the earphone, the listener can easily listen to the information sound while listening to the listening sound.

(The First Modification)

In an acoustic control apparatus 200 of the first modification, operation of the detection unit 20 is different from that of the acoustic control apparatus 100. As to the same component as the acoustic control apparatus 100, the explanation is omitted.

In the first modification, the detection unit 20 detects a direction of the information sound. Here, the direction represents a direction from which the listener listens to the information sound. For example, the acoustic control apparatus 200 or the earphone equips a microphone (not shown in FIG. 1). The detection unit 20 can detect the direction of the information sound based on a sound detected by this microphone.

For example, by using acoustic intensity method known in technical region of noise or sound source search, the detection unit 20 detects the direction of the information sound. The acoustic intensity is "a flow of energy of sound passing through a unit area per a unit time", and the unit is $W/m^2$. For example, by putting a plurality of microphones into the earphone, the flow of energy of sound is measured, and a direction of the flow with an intensity of sound can be measured as a vector quantity. By using a time difference of the information sound passing between two microphones, the detection unit 20 detects a direction of the information sound.

Here, sound pressure waveforms of two microphones are $P_1(t)$ and $P_2(t)$. The acoustic intensity I is calculated by following equations, as a time average of a product of an averaged sound pressure P(t) and a particle velocity V(t).

$$P(t) = (P_1(t) + P_2(t))/2 \tag{3}$$

$$V(t) = (-1/\rho\Delta r)\int(P_1(\tau) \cdot P_2(\tau))d\tau \tag{4}$$

$$I = \overline{P(t) \cdot V(t)} \tag{5}$$

In the equations (3)~(5), ρ is an air density, and Δr is a distance between two microphones. A frequency range to be measured depends on the distance Δr between two microphones. From a relationship between the distance Δr and a wave length λ of sound, in general, the smaller the distance Δr is, the higher the frequency range to be measured is. For example, if Δr is 50 mm, the upper limit frequency is 1.25 kHz. Here, if Δr is 12 mm, the upper limit frequency is extended to 6.3 kHz. Preferably, Δr is larger than (or equal to) λ/2. More preferably, Δr is approximately equal to λ/3. Namely, a speech band is included in a frequency range starting from 340 Hz. Accordingly, Δr is desired to be approximately equal to 33 cm~50 cm.

The correction unit 30 selects the acoustic transfer characteristic based on a direction of the information sound (detected by the detection unit 20).

On the basis of a cross point (Q') of a perpendicular line from a position of the information sound (S) onto X-axis, under the condition that a cross point of a perpendicular line from a position of the listening sound (P) onto X-axis is included in the listener's side area than the cross point (Q'), the correction unit 30 selects the acoustic transfer characteristic corresponding to any of directions of the listening sound (P). More preferably, if a position of the information sound (S) exists in the first quadrant or the fourth quadrant (the right direction from the listener), the correction unit 30 selects the acoustic transfer characteristic corresponding to any of directions (the left direction from the listener) under the condition ($90° \leq \theta_S \leq 270°$). Furthermore, if a position of the information sound (S) exists in the second quadrant or the third quadrant (the left direction from the listener), the correction unit 30 selects the acoustic transfer characteristic corresponding to any of directions (the right direction from the listener) under the condition ($0° \leq \theta_S \leq 90°$) or ($270° \leq \theta_S \leq 360°$).

According to the acoustic control apparatus 200 of the first modification, at a timing when the information sound is inputted, by shifting the sound image of the listening sound so as to depart from a direction of the information sound, even if the listener listens to the listening sound with the earphone, the listener can easily listen to the information sound while listening to the listening sound.

(The Second Modification)

In an acoustic control apparatus 300 of the second modification, operation of the detection unit 20 is different from that of the acoustic control apparatus 100. As to the same component as the acoustic control apparatus 100, the explanation is omitted.

For example, in order to detect whether information sound (localization sound) is included in a sound detected by a microphone for binaural-recording (equipped with an earphone), IACF is used. In the second modification, for example, by executing IACF analysis based on the sound detected by the microphone, the detection unit 20 detects the information sound and the arriving direction thereof.

IACF represents to what extent two sound pressure waveforms transmitted to both ears are coincident, which is given by following equation. Here, $P_L(t)$ is a sound pressure entered into a left ear at a time t, and $P_R$ (t) is a sound pressure entered into a right ear at the time t. Furthermore, t1 and t2 are measurement time, for example, t1=0 and t2=∞. In actual calculation, t2 may be set to a measurement time of a reverberation time, for example, $10_{sec}$. Furthermore, τ is a correlative time, for example, a range thereof is $-1_{sec}$~$1_{sec}$. Accordingly, a time interval ΔT on a signal to calculate a cross-correlation function between both ears needs to be set larger than (or equal to) the measurement time. In the second embodiment, the time interval ΔT is $0.1_{sec}$.

$$IACF(\tau) = \frac{\int_{t1}^{t2} P_L(t)P_R(t+\tau)dt}{\int_{t1}^{t2} P_L^2(t)dt - \int_{t1}^{t2} P_R^2(t)dt} \quad (5)$$

In the second modification, for example, the arriving direction of the information sound is specified by unit of 45°. In this case, the user's front-back direction is hard to be discriminated. Accordingly, as a sound image direction to be presented to the user, five directions, i.e., a front (including a back), a diagonally left (including a diagonally forward left and a diagonally backward left), a left side, a diagonally right (including a diagonally forward right and a diagonally backward right), and a right side, are candidates. In the second modification, in correspondence with these five directions, five time range are set by following equations (7)~(11). A time range represented by an equation (7) corresponds to the front (0° or 180°). A time range represented by an equation (8) corresponds to the diagonally left (45° or 135°). A time range represented by an equation (9) corresponds to the left side (90°). A time range represented by an equation (10) corresponds to the diagonally right (225° or 315°). A time range represented by an equation (11) corresponds to the right side (270°).

A peak time τ is equivalent to a time difference between both ears, which is changed by a difference of incident angle thereto. Accordingly, the time range of the respective directions is unequal. Furthermore, a person is sensitive to decision whether a sound is arriving from the front or the back. As to the sound arriving from other directions, the person has a tendency to decide that the sound image direction is diagonal. Accordingly, as to the diagonal direction, as shown in the equations (8) and (10), a wide time range is set.

$$-0.08_{sec} < \tau(i) < 0.08_{sec}. \quad (7)$$

$$0.08_{sec} \leq \tau(i) < 0.6_{sec} \quad (8)$$

$$0.6_{sec} \leq \tau(i) < 1_{sec} \quad (9)$$

$$-0.6_{sec} < \tau(i) \leq -0.08_{sec}. \quad (10)$$

$$-1_{sec} < (i) \leq -0.6_{sec} \quad (11)$$

Based on a sound detected by the microphone (equipped with the earphone), IACF is calculated at an interval of ΔT. Here, an occurrence time (peak time) of the maximum peak is τ(i), and an intensity thereof is γ(i) (i=1~N).

In this case, for example, among N maximum peaks calculated within one second, if maximum peaks of which number is larger than (or equal to) a predetermined number are included in one of a plurality of specific time ranges (in the second modification, five time ranges), the information sound is decided to arrive from a direction corresponding to the one time range.

Figure 5:
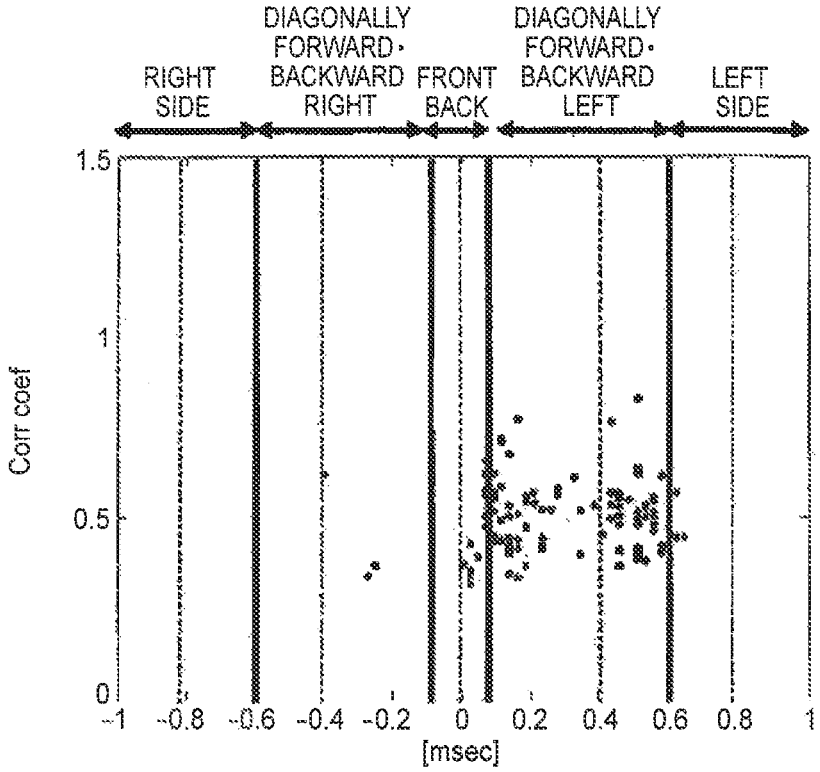
FIG. 5 is a schematic diagram showing IACF analysis result according to the first embodiment.

FIG. 5 shows IACF-analysis result based on the sound arrived from a TV positioned at diagonally backward left (135°) of the listener. Here, the sampling is 44.1 kHz, and maximum peaks of 100 points are calculated at an interval of $0.1_{sec}$ within ten seconds. As a result, the maximum peaks are included in a time range including $0.4_{sec}$ (corresponding to 135°) shown by dotted line in FIG. 5. Namely, from this result, the sound (information sound) is decided to arrive from the direction of 135° approximately.

In the second modification, based on the sound detected by the microphone (equipped with the earphone), the detection unit 20 calculates IACF every ΔT according to the equation (6). Among N maximum peaks calculated within a predetermined time, if maximum peaks of which number is larger than (or equal to) a predetermined number are included in one of a plurality of specific time ranges (in the second modification, five time ranges), the information sound is included in the sound detected by the microphone (equipped with the earphone). In this case, for example, by previously setting a typical time of the respective time ranges, the detection unit 20 specifies a direction corresponding to the typical time as the arriving direction.

According to the acoustic control apparatus 300 of the second modification, in comparison with the case of detecting the information sound by using a sound pressure level, by using IACF by which the information sound is evaluated including the arriving direction, the information sound can be detected with high accuracy.

(The Second Embodiment)

Figure 6:
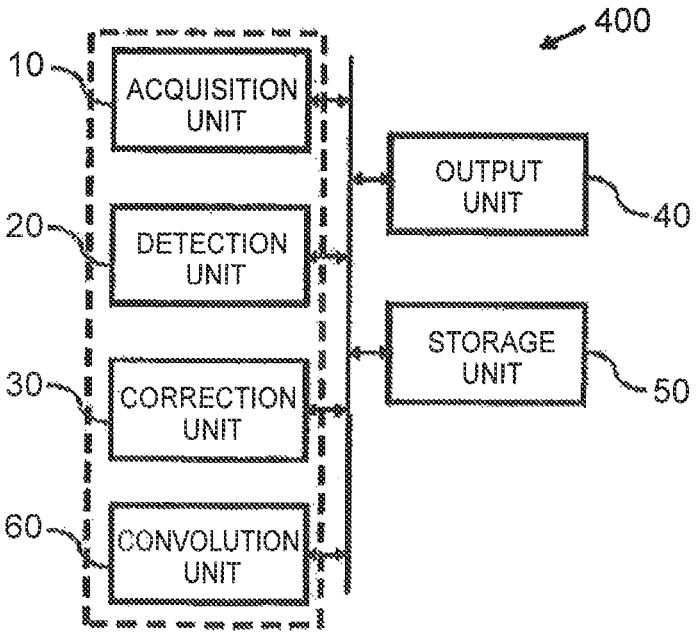
FIG. 6 is a block diagram of the acoustic control apparatus according to a second embodiment.

FIG. 6 is a block diagram of an acoustic control apparatus 400 of the second embodiment. As to the same component as the acoustic control apparatus 100, the explanation is omitted.

The acoustic control apparatus 400 includes a convolution unit 60 to localize an information sound along the arriving direction by convolution operation and overlap the listening sound with the information sound. This unit is different feature from the acoustic control apparatus 100.

The convolution unit 60 selects one acoustic transfer characteristic (a second acoustic transfer characteristic) corresponding to the direction of the information sound from a plurality of acoustic transfer characteristics stored in the storage unit 50, and generates an acoustic signal $P'_L$ for the left earphone and an acoustic signal $P'_R$ for the right earphone by convoluting the selected acoustic transfer characteristic with the information sound. Here, the acoustic transfer characteristic (the second acoustic transfer characteristic) used by the convolution unit 60 is different from the acoustic transfer characteristic (the first acoustic transfer characteristic) used by the correction unit 30. The convolution unit 60 overlaps each acoustic signal (a third acoustic signal) with each acoustic signal (a second acoustic signal) generated by the correction unit 30, and outputs the overlapped acoustic signals (a fourth acoustic signal) to the output unit 40.

For example, in order to localize the information sound having the arriving direction "θ=90°", the convolution unit 60 generates the acoustic signal $P'_L$ for the left earphone and the acoustic signal $P'_R$ for the right earphone by following equation. Here, $H_{L,90}$ represents an acoustic transfer characteristic to the left ear, $H_{R,90}$ represents an acoustic transfer characteristic to the right ear, and S' represents an acoustic signal of the information sound.

$$P'_L=H_{L,90}\times S' \tag{12}$$

$$P'_R=H_{R,90}\times S' \tag{13}$$

By overlapping each acoustic signal (the third acoustic signal) with each acoustic signal (the second acoustic signal), the convolution unit 60 generates the acoustic signal $P_{LOUT}$ for the left earphone and the acoustic signal $P_{ROUT}$ for the right earphone by following equation.

$$P_{LOUT}=P_L+P'_L \tag{14}$$

$$P_{ROUT}=P_R+P'_R \tag{15}$$

Here, a sound image direction of each acoustic signal (the second acoustic signal) generated by the correction unit 30 is different from a sound image direction of each acoustic signal (the third acoustic signal) generated by the convolution unit 60.

Figure 7:
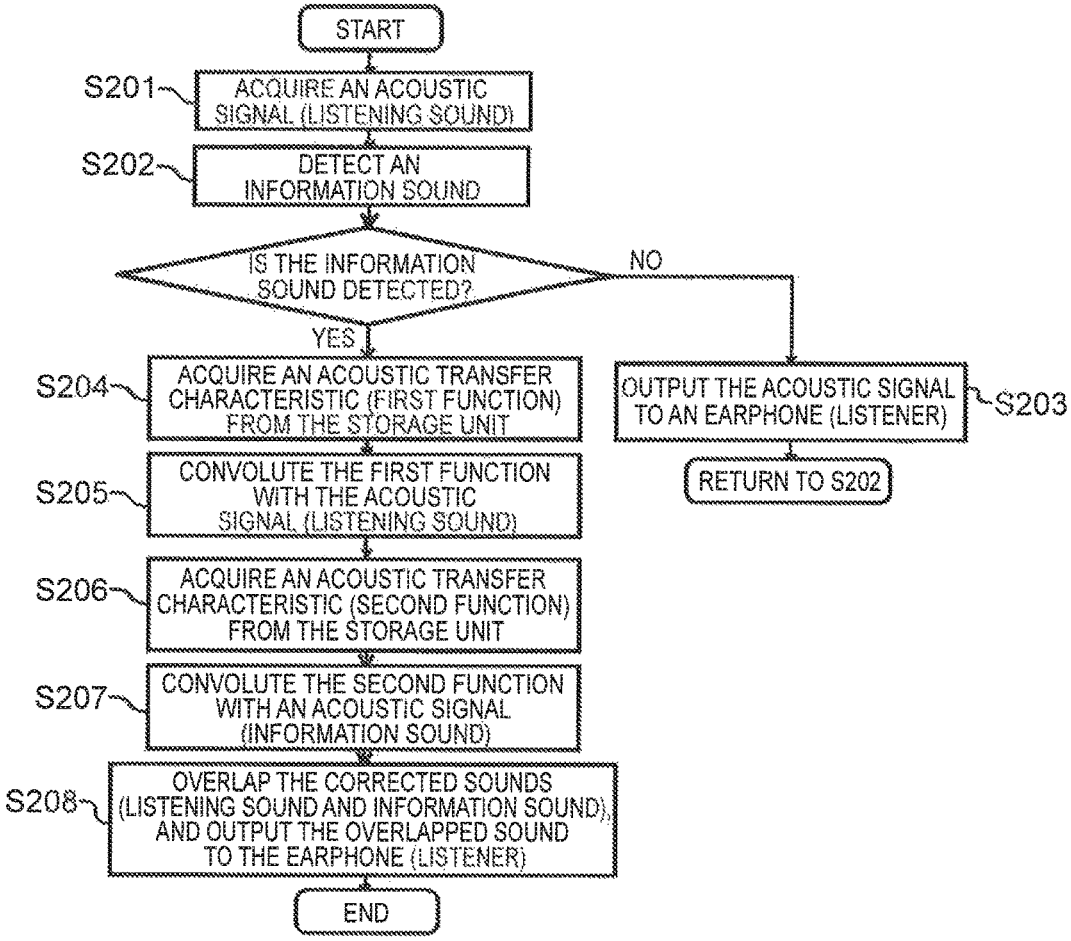
FIG. 7 is a flow chart of processing of the acoustic control method according to the second embodiment.

FIG. 7 is a flow chart of processing of the acoustic control method according to the second embodiment. In FIG. 7, processing of S201~S205 is same as that of S101~S105 in FIG. 2. Accordingly, its explanation is omitted.

At S206, the convolution unit 60 acquires the acoustic transfer characteristic (a second function) from the storage unit 50.

At S207, the convolution unit 60 corrects the third acoustic signal to the fourth acoustic signal by convoluting the second function with the acoustic signal (the third acoustic signal) of the information sound.

At S208, the output unit 40 outputs an acoustic signal (a fifth acoustic signal) generated by overlapping the second acoustic signal with the fourth acoustic signal to the earphone (the listener).

Above-mentioned steps are repeated until acquisition of the first acoustic signal is completed, or while the detection unit 60 is detecting the information sound.

(The Third Modification)

In an acoustic control apparatus 500 of the third modification, for example, the information sound is wirelessly detected as the acoustic signal (data). By using this acoustic signal (acquired by the acquisition unit 10), the information sound is overlapped with the listening sound. The listening sound including the information sound is presented to a listener. As a result, for example, while the listener (listening to music with the acoustic control apparatus 500) is shopping at a department store, a guide voice (from each shop in the department store) replayed from the acoustic control apparatus 500 can be presented to the listener.

In the convolution unit 60 of the third modification, by overlapping the information sound (detected as the acoustic signal by the detection unit 20) with the acoustic signal corrected by the correction unit 30, the listening sound including the information sound is acquired. Here, a localization direction of the information sound can be determined based on a correlative positional relationship between the listener and each shop (origin of the information sound).

For example, by GPS function prepared by the acoustic control apparatus 500, the convolution unit 60 specifies a location of the acoustic control apparatus 50 and a location of a shop which sends the information sound. The convolution unit 60 convolutes the acoustic transfer characteristic with the information sound so as to maintain the correlative positional relationship between the acoustic control apparatus 50 and the shop, i.e., so that the information sound is localized along a direction where the shop is located on the basis of the location of the acoustic control apparatus 500. Here, the acoustic transfer characteristic (the second acoustic transfer characteristic) used by the convolution unit 60 is different from the acoustic transfer characteristic (the first acoustic transfer characteristic) used by the correction unit 30.

According to the acoustic control apparatus 500 of the third modification, as to a listener who is listening to music with the earphone, for example, useful information from the shop can be effectively presented to the listener so as not to disturb the listening of music.

Figure 8:
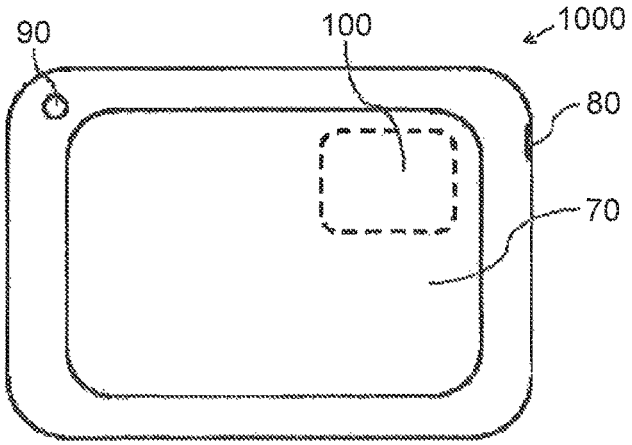
FIG. 8 is a block diagram of an electronic device including the acoustic control apparatus according to the first and second embodiments.

FIG. 8 is a schematic diagram showing an electronic device 1000 equipping the acoustic control apparatus of the respective embodiments or modifications. In FIG. 8, the electronic device 1000 is a tablet terminal.

The electronic device 1000 equips the acoustic control apparatus 100 of the first embodiment, a display 70 such as a touch panel, an earphone jack 80, and a microphone 90. The detection unit 20 of the acoustic control apparatus 100 is connected to the microphone 90 via a connection cable (not shown in FIG. 8). The detection unit 20 detects the information sound based on a sound collected by the microphone 90. Furthermore, the output unit 40 of the acoustic control apparatus 100 is connected to the earphone jack 80 via a connection cable (not shown in FIG. 8). Under the condition that an earphone (not shown in FIG. 8) is connected to the earphone jack 80, the output unit 40 outputs the second acoustic signal to the earphone via the earphone jack 80.

In place of the acoustic control apparatus 100, the electronic device 1000 may equip any of the acoustic control apparatuses 200, 300, 400, 500 of another embodiment or modification. Furthermore, in place of the microphone 90 equipped by the electronic device 1000, the earphone (connected to the earphone jack 80 of the electronic device 1000) may equip the microphone 90. In this case, by accepting the acoustic signal of the sound (collected by the microphone) via the earphone jack 80, the acoustic control apparatus 100 detects the information sound based on this acoustic signal.

As mentioned-above, according to the acoustic control apparatus or the acoustic control method of at least one of embodiments and modifications, while the listener is listening to music with the earphone, the listener can listen to the information sound during listening to the music (the listening sound).

While certain embodiments have been described, these embodiments have been presented by way of examples only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for controlling an acoustic signal, comprising:

an acquisition unit that acquires a first acoustic signal;

a storage unit that stores a plurality of acoustic transfer characteristics from different virtual positions to a listening position, the different virtual positions being respectively located along different directions from the listening position, the acoustic transfer characteristics being respectively corresponding to the different directions;

a detection unit that detects an arriving direction of an information sound;

a correction unit that, when the detection unit detects the information sound:

selects a first acoustic transfer characteristic from the plurality of acoustic transfer characteristics, based on the arriving direction, and corrects the first acoustic signal to a second acoustic signal by convoluting the first acoustic signal with the first acoustic transfer characteristic from a virtual position to the listening position, the virtual position being one of the different virtual positions and located along a first direction not overlapped with the arriving direction from the listening position; and an output unit that outputs the second acoustic signal;

wherein:

the acquisition unit acquires a third acoustic signal of the information sound, the correction unit corrects the third acoustic signal toa fourth acoustic signal by convoluting the third acoustic signal with a second acoustic transfer characteristic different from the first acoustic transfer characteristic, and the output unit outputs a fifth acoustic signal generated by overlapping the second acoustic signal with the fourth acoustic signal.

2. The apparatus according to claim 1, wherein the first direction is any of the different directions excluding the arriving direction.

3. The apparatus according to claim 2, wherein the detection unit detects the arriving direction based on a cross-correlation function between both ears of a user.

4. An electronic device including the apparatus of claim 1.

5. A method for controlling an acoustic signal, comprising:

acquiring a first acoustic signal;

detecting an arriving direction of an information sound;

when the information sound is detected, selecting a first acoustic transfer characteristic from a plurality of acoustic transfer characteristics from different virtual positions to a listening position, based on the arriving direction, the different virtual positions being respectively located along different directions from the listening position, the acoustic transfer characteristics respectively corresponding to the different directions;

correcting the first acoustic signal to a second acoustic signal by convoluting the first acoustic signal with the first acoustic transfer characteristic from a virtual position to the listening position, the virtual position being one of the different virtual positions and located along a first direction not overlapped with the arriving direction from the listening position; and outputting the second acoustic signal;

wherein:

the acquiring includes acquiring a third acoustic signal of the information sound, the correcting includes correcting the third acoustic signal to a fourth acoustic signal by convoluting the third acoustic signal with a second acoustic transfer characteristic different from the first acoustic transfer characteristic, and the outputting includes outputting a fifth acoustic signal generated by overlapping the second acoustic signal with the fourth acoustic signal.

* * * * *